United States Patent [19]

Babuka et al.

[11] 4,059,323

[45] Nov. 22, 1977

[54] APPARATUS FOR INTERCONNECTING PLURAL MATING MEMBERS

[75] Inventors: Robert Babuka, Vestal; John Bernard Harris, Endicott, both of N.Y.

[73] Assignee: International Business Machines Corporation, Armonk, N.Y.

[21] Appl. No.: 685,951

[22] Filed: May 13, 1976

[51] Int. Cl.[2] ..... H01R 13/54

[52] U.S. Cl. ..... 339/75 M; 339/17 CF

[58] Field of Search ..... 339/17 CF, 75 M, 75 MP, 339/91 R, 176 MP

[56] References Cited

U.S. PATENT DOCUMENTS

| | | | |
|---|---|---|---|
| 3,568,134 | 3/1971 | Anhalt et al. | 339/75 MP |
| 3,947,081 | 3/1976 | Peterson | 339/75 M |
| 3,977,749 | 8/1976 | Langenbach | 339/75 M |

FOREIGN PATENT DOCUMENTS

| | | | |
|---|---|---|---|
| 2,252,670 | 6/1975 | France | 339/75 MP |

*Primary Examiner*—Joseph H. McGlynn
*Assistant Examiner*—E. F. Desmond
*Attorney, Agent, or Firm*—Norman R. Bardales

[57] ABSTRACT

Plural first and second mating members are simultaneously interconnected in mutually exclusive pairs by apparatus which includes a cam mechanism that in addition self-relieves any undesirable stresses when present in the apparatus as a result of interconnecting the plural mating members. In the preferred embodiment, the mating members are male electrical connector pins and co-acting female bifurcated spring type connectors.

10 Claims, 21 Drawing Figures

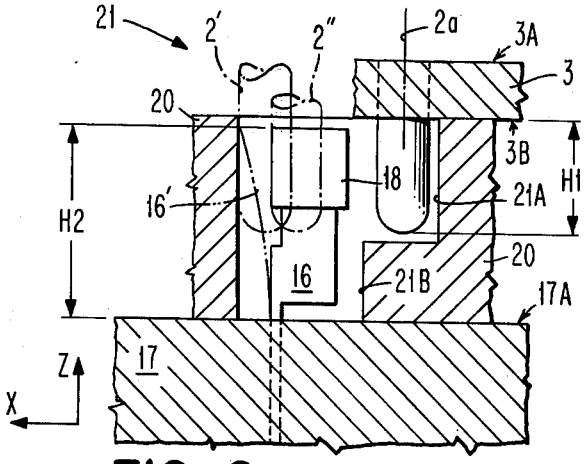
FIG. 6
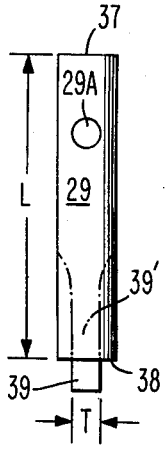
FIG. 9
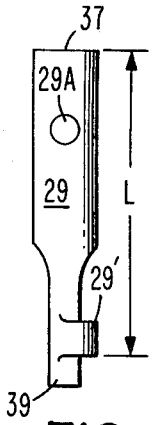
FIG. 10
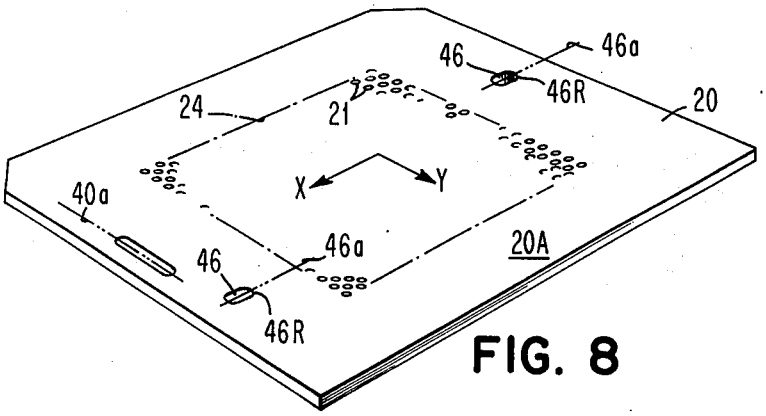
FIG. 8
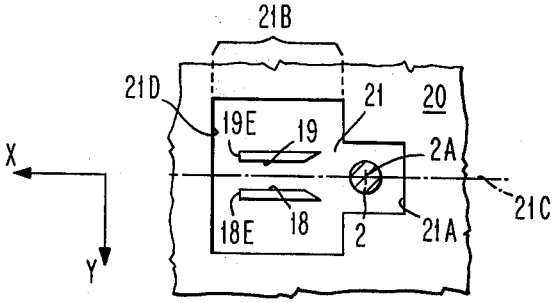
FIG. 7a
FIG. 7d
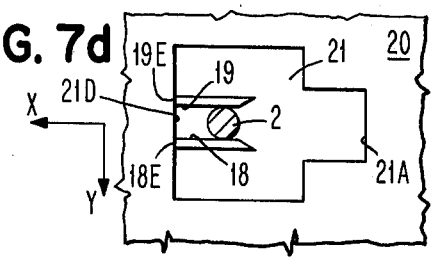
FIG. 7b
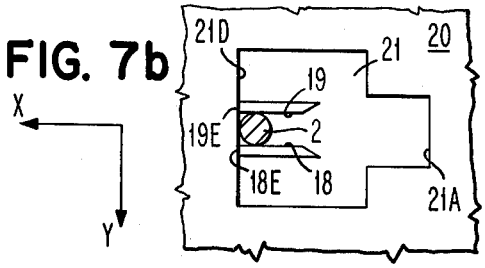
FIG. 7c
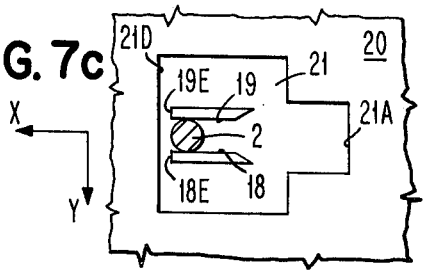

APPARATUS FOR INTERCONNECTING PLURAL MATING MEMBERS

BACKGROUND OF THE INVENTION

1. Field of the Invention

This invention relates to the interconnection of mating members and more particularly to the interconnection of such members by cam actuator means.

2. Description of the Prior Art

The publication entitled "Connector Actuator Device" by J. B. Harris, co-inventor herein, IBM Technical Disclosure Bulletin, Vol. 16, No. 9, February 1974, pages 2839–2840, describes a cam actuator device for making simultaneous connection between two mating sets of plural connectors. More specifically, it provides simultaneous mating of an area array of electrical male pin connectors to female contact connectors. For the particular application described therein, the pin connectors are part of a module member. Examples of such members are high density integrated circuit modules or chips. The female connectors on the other hand are of the bifurcated spring type. A description of one such type of female connector is contained in U.S. Pat. No. 3,915,537, "Universal Electrical Connector", John B. Harris, the aforementioned co-inventor herein, et al, assigned to the common assignee herein and incorporated herein by reference. This type, in general, has a pair of parallel aligned contact surfaces, each of which is located on one of the bifurcated resilient arms that extend upwardly from a common main body portion. For the particular application described in the publication, these identical female connectors are mounted on a planar printed circuit board in an array corresponding to the pin array with which they are to be mated. For this purpose, each female connector has a mounting stem dependent from its main common body portion. As a result, the main body portion, resilient arms and contact surfaces of each connector are in an upright position and are extended at a uniform height above the surface of the printed circuit board to which they are mounted and such that each female connector in the array is oriented in the same direction on the board.

The cam actuator device of the publication includes an elongated cylindrical shaft and an eccentric cam portion that is integrally formed on the shaft. The shaft and cam portions are configured in the form of a crank. More particularly, the eccentric cam portion, which has a much shorter cylindrical shape but is substantially the same diameter as that of the shaft, is formed at one end of the shaft. The respective center axes of the two respective cylindrical shapes, to wit: the eccentric cam portion and shaft, are parallel and offset with respect to each other. The cam portion thus protrudes in a radial direction outwardly from the shaft and extends below the end of the shaft to which it is joined. The shaft acts as the crank handle and is pivotable about the center axis of the eccentric member.

The actuator device also includes three interlinked members which are operated by the crank. The three members are referred to in the publication as a drive block, a square block and a slide plate. Briefly, the drive block is slidably mounted in a linear manner about two parallel cant edge faces of the slide plate which fits in a recess provided in the bottom of the drive block for this purpose. The slide plate has a circular hole in which the cam portion of the crank has a pivotable bearing. The shaft in turn extends upwardly from the roof of the bottom recess and through a linear elongated guide slot formed in a midsection of the drive block. The guide slot lies in a plane parallel to the plane of the slide plate and its elongated axis is orthogonal to the linear direction in which the drive block is slidable on the slide plate.

Another recess or slot is formed inwardly from the top of the drive block down to and in communication with the narrower aforementioned guide slot located in the drive block's aforementioned midsection. This upper recess is rectangular in shape and is larger and parallel to and symmetrically disposed about the narrower guide slot. The aforementioned square block is slidably mounted in the upper recess. The square block has a center circular hole through which the shaft extends upwardly for a considerable distance above the co-planar upper surfaces of the drive and square blocks.

The drive block is affixed to the array pin module member and the slide plate is affixed to a member referred to in the publication as the base connector carrier member or simply as the base member. The base member has a planar configuration. A plurality of recesses, i.e. openings, extend between the top and bottom surfaces of the base member. Each recess is equipped with one of the female spring-type connector elements. More specifically, the spring-type female connectors gain access to the recesses from the bottom side of the base member. Thus, with the female connectors in the recesses, the upper surface of the printed circuit board from which the female connector extend is in contact with the bottom surface of the base member. It should be understood that in the aforementioned publication, the printed circuit board is not illustrated.

Each of the pins which extend from the bottom surface of the module member on the other hand gain access to one of the recesses of the base member from the latter's top side. With the pins in the recesses, the bottom surface of the module member is in contact with the upper surface of the base member. With the printed circuit board and module member so assembled with the base member, the bottom surface of the slide plate is in contact with the upper surface of the planar module member. Downwardly extended mechanical connection pins affix the slide plate to the base member, the module members having openings therethrough through which these mechanical connections pass. These lastmentioned openings are sufficiently large so that the mechanical pins do not obscure the relative movement between the module member and base member next to be described.

When the printed circuit board, base and module members are initially assembled, the male pin and female connector to be mated are juxtaposed in opposite ends of the particular recess of the base member in which they are located. This provides a no-insertion force type of electrical connection. For purposes of explanation, it is assumed that the printed circuit board and base member and, hence, the slide plate are stationary. As a result, rotation, i.e. pivoting, of the shaft about the pivotal bearing causes the drive block and module member to move relative to the base member. More specifically, the moment created by the rotation of the shaft provides a radial force component which causes the drive block to slide across the slide plate in one direction and a tangential force component which causes the square block to slide in the upper recess of the drive block in an orthogonal direction. As a result, the actuator device causes each pin to move simultaneously in the same linear direction as the drive block. As a result, each pin is placed between and in wiping contact with the two contact areas of its associated female connector with which it is aligned, thereby effecting the mating and hence, electrical interconnection of the pin and its female connector. At the same time, however, any lateral movement of the pin relative to the contact areas is mitigated by the kinematics of the actuator device.

The aforedescribed device of the prior art publication has several disadvantages. The number of interconnected and machined parts required for the device made it rather complex. Its complexity, furthermore, makes it difficult and costly to fabricate. Moreover, it causes the base member to be placed under undesirable stress, as will be explained in greater detail hereinafter when describing the present invention. Furthermore, should the actuator device be continued to be rotated, i.e. pivoted, in the same rotational direction after the mating was effected, it continued to drive the pins in the same linear direction and thus, the mated connectors were capable of placing the base member under further undesirable stress. Moreover, the elongated shaft, if accidentally skewed from the normal, i.e. perpendicular, would cause the parallel relationships between the respective planes of the module member, printed circuit board and/or base member to assume a non-parallel relationship which in turn was susceptible to misaligning the pins with their respective female connectors. As a result, if a mating operation were to be initiated when a non-parallel relationship existed, damage and/or failure of the members to be mated could result and/or an improper mating could occur. Moreover, in this prior art actuator device, the shaft and cam portion was such that it could not be readily removed from the assembly and, hence, a separate shaft and cam portion was required to be dedicated for each such assembly. Moreover, because the shaft and cam portion remained with the assembly, it was subject to accidental skewing resulting in the aforementioned non-parallel planar relationships and harmful effects thereof.

SUMMARY OF THE INVENTION

It is an object of this invention to provide apparatus for interconnecting plural mating members by simple cam means.

It is another object of this invention to provide apparatus of the aforementioned kind which self-relieves any undesirable stresses when present in the apparatus caused by the interconnection of the plural mating members.

Another object of this invention is to provide apparatus of the aforementioned kind for making high density electrical interconnections.

Another object of this invention is to provide apparatus of the aforementioned kind which interconnects plural mating electrical connector members of the male connector pin and co-acting female bifurcated spring connector types.

It is still another object of this invention to provide apparatus of the aforementioned kind which maintains the mating members in a predetermined aligned relationship.

Still another object of this invention is to provide apparatus of the aforementioned kind which includes a universal and/or disengageable cam shaft.

Accordingly, one of the features of this invention is to provide apparatus for simultaneously interconnecting plural first mating member means with plural second mating member means in mutually exclusive pairs. The apparatus has first assembly means for supporting the plural first member means in a predetermined array. Second assembly means supports the second member means in a corresponding array. The first and second assembly means are juxtaposed with respect to each other to provide relative linear motion therebetween. Cam means effects the linear motion in a bidirectional manner in response to a rotational force applied thereto about a predetermined axis of rotation. The rotational force is applied in a given direction about the axis between first and second predetermined angular positions to provide the linear motion in a first linear direction to effect the interconnecting of the plural first and second mating member means. The rotational force is further applied in the given direction about the axis between the second angular position and a third predetermined angular position to provide the relative linear motion in an opposite second linear direction to relieve undesirable stresses when present in the apparatus caused by interconnecting said first and second plural member means.

The foregoing and other objects, features and advantages of the invention will be apparent from the following more particular description of preferred embodiments of the invention, as illustrated in the accompanying drawing.

Figure 1:
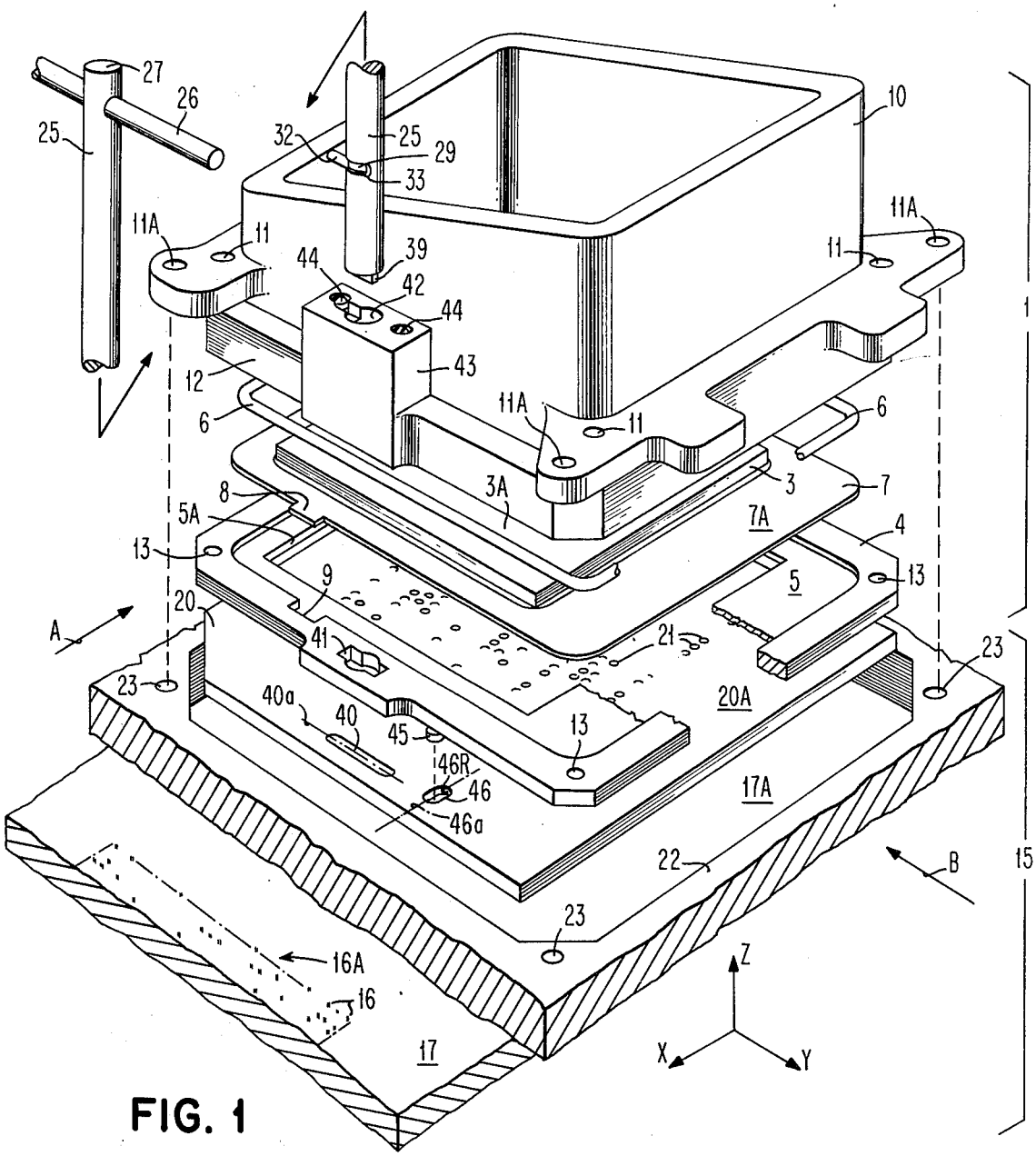
FIG. 1 is an exploded perspective view of a preferred embodiment of the apparatus of the present invention.

FIGS. *2a* – *2c* are enlarged front elevation views of the shaft of the cam means of FIG. 1 as viewed in the direction A thereof illustrating three different angular positions, respectively, of the shaft about the cam means axis of rotation;

FIGS. *3a* – *3c* are partial top plan views of the shaft of FIG. 1 thereof corresponding to the three angular positions of FIGS. *2a* – *2c*, respectively.

FIGS. *4a* – *4c* are partial bottom plan views illustrating the relationships of the shaft with respect to the module member carrier assembly for the three angular shaft positions of FIGS. *2a* – *2c*, respectively;

FIGS. *5a* – *5c* are partial bottom plan views illustrating the interrelationships of the shaft, module member carrier assembly and base connector carrier member for the three angular shaft positions of FIGS. *2a* – *2c*, respectively;

FIG. 6 is a partial enlarged cross-sectional view illustrating schematically an opening in the base connector carrier member with a pair of mating members therein of FIG. 1, as viewed in the direction B thereof;

FIGS. *7a* – *7c* are partial top plan views of smaller size of the mating members with respect to the base connector carrier member of FIG. 6 illustrating their relative positions for the three angular shaft positions of FIGS. *2a* – *2c*, respectively, and as viewed facing the direction B of FIG. 1;

FIG. *7d* is an additional partial top plan view similar to the views of FIGS. *7a* – *7c* illustrating, for sake of clarity, the relative positions of the mating members with respect to the base connector carrier member when the shaft is positioned to an angular position between those illustrated in FIGS. *2a* and *2b*, respectively;

FIG. 8 is a perspective view of the base member of FIG. 1;

FIG. 9 is a side elevation view illustrating in solid outline form the cam portion member of the shaft of FIG. 1 and in phantom outline form another embodiment thereof; and FIG. 10 is a side elevation view of still another embodiment of the cam portion member of the cam means of the present invention.

In the FIGURES, like elements are designated with similar reference numerals.

DESCRIPTION OF THE PREFERRED EMBODIMENTS

For sake of explanation and/or clarity, the embodiments of FIGS. 1 – 10 are described with respect to an X,Y,Z reference system. Direction arrows A, B of FIG. 1 are parallel to the X and Y axis, respectively.

Referring to the Figures and FIG. 1 in particular, the assembly generally indicated by the reference character 1 supports plural first mating members, not shown. In the preferred embodiment the mating members supported by assembly 1 are male electrical pin connectors, e.g. pin 2 of FIG. 6. The pins 2 are part of a high density, i.e. high circuit density and/or preferably high density interconnections, integrated circuit module or chip 3 of the area array pin type. The pins 2 extend outwardly at a uniform height H1 from and normal to the bottom surface 3B of the planar module 3, cf. FIG. 6.

Assembly 1 includes a rectangular planar ring-like member 4 having an integral inner rim-like planar shelf portion 5. Mounted on the shelf 5 by a retaining ring 6, partially shown, is ring-shaped plate 7. Module 3 is affixed at its periphery to the plate 7 in a concentric manner with respect to the opening of plate 7. Plate 7 has one or more alignment or registration lugs or tabs, e.g. lug 8, which co-act with one or more recesses, e.g. recess 9, formed on the member 4 for appropriate orientation and registration of the module 3 in the assembly 1. Secured to the upper surface of the member 4 is a four-sided cooling chamber 10. By way of example, chamber 10 is secured to member 4 by bolts, not shown, which first pass through the four corner holes, e.g. holes 11, located in extended parts of the ring-like flange 12 integrally formed on member 10 and then threadably engage four aligned holes, e.g. holes 13, of member 4. When finally assembled, a fluid coolant, not shown, such as a suitable liquid coolant is encapsulated in the chamber 10, an appropriate cover and gasket and/or seals, not shown, being provided to effect the encapsulation. In this manner, the coolant in chamber 10 contacts the upper suface 3A, i.e. the non-pin side, of module 3 and upper surface 7*a* of its associated plate 7., It should be understood that the module 3 and its surrounding plate 7, are thus enclosed except for the respective bottom surface 3B, cf. FIG. 6, of the module 3 from which the pins 2 extend and a portion of the corresponding bottom surface, not shown, of the associated plate 7. This lastmentioned portion of the bottom surface of plate 7 is the part which does not come in contact per se with the ring shelf 5 of member 4 to which it is mounted and which is exposed in the opening 5A of shelf 5.

The lower assembly generally indicated by the reference character 15 in FIG. 1 supports plural second mating members, e.g. member 16 of FIG. 6, which are capable of being mated with the mating members 2 that are supported by the other assembly 1. Preferably, mating members 16 are female electrical connectors of the bifurcated spring type as shown in FIG. 6 and are similar to the type described in the aforementioned U.S. Pat. No. 3,915,537.

Members 16 are mounted on a printed circuit board 17 of assembly 15, which may for example, be of the multilayer type. For sake of clarity, board 17 is illustrated schematically in the drawing and thus the multilayers, associated printed circuit conductors, contact lands and plated through holes are omitted therein. Members 16 are mounted on board 17 in an array which corresponds to the array of pins 2 of module 3 to which they are to be mated. The members 16 of the array with respect to each other extend the same uniform height H2, cf. FIG. 6, above the upper surface 17A of board 17 and are oriented in the same manner. More specifically, each member 16 is so oriented that its two contact surfaces 18, 19, cf. FIG. 7*a*, are aligned in parallel with the X axis, which is the axis along which relative motion is effected between the assemblies 1 and 15 by the cam means of the present invention as hereinafter described.

Assembly 15 has a base connector carrier insulator member 20, cf. FIG. 8, which has a plurality of recesses 21 arranged in an array corresponding to that of the members 16 and, hence, pins 2. The member 20 is affixed to the printed circuit board 17 by suitable means, not shown, such as screws or the like, and such that a member 16 is equipped in each recess 21, cf. FIG. 6.

A ring-like frame support 22 of assembly 15 is affixed to board 17 by suitable means, not shown, such as screws or the like. Support 22 supports assembly 1 when the mating of pins 2 and members 16 is being done. After the mating has been effected by the cam means of the present invention as hereinafter described, the assemblies 1 and 15 are affixed to each other by bolts, not shown, which first pass through four corner holes, e.g. holes 11A, of flange 12 of member 10 and from there into threadable engagement with aligned holes, e.g. holes 23, of member 22. Registration means such as, for example, the hereinafter described guide pins 45 and grooves 46 keep the assemblies 1 and 15 and, hence, pins 2 and members 16 in appropriate alignment when being assembled together.

The printed circuit board 17 of FIG. 1 is preferably adapted to commonly accommodate plural pairs of connected assemblies 1 and 15 in an array-like manner. It should thus be understood that the array 16A of members 16 actually shown in FIG. 1 are part of another lower assembly, not shown, which is identical and adjacent to the assembly 15 shown in FIG. 1 and which co-acts with another upper assembly, not shown, that is identical to assembly 1. It should be further understood that in FIG. 1 the mating members of the assembly 15 are obscured from view by the overlaying member 20. The array 24, FIG. 8, of holes 21 of member 20 of FIG. 1, as previously explained, has equipped in each of the holes 21 one of the lastmentioned mating members, not shown in FIG. 1, of assembly 15. Moreover, frame support 22 is configured in a grid-like manner as an array of adjacent integral similar ring-like sections, each section being identical to the part of frame 22 shown in FIG. 1. Each section in turn is associated with one of the aforementioned plural pairs of assemblies.

Figure 2A:
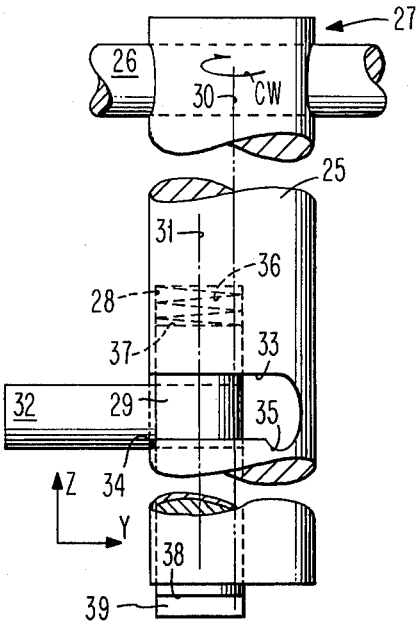
Figure 2B:
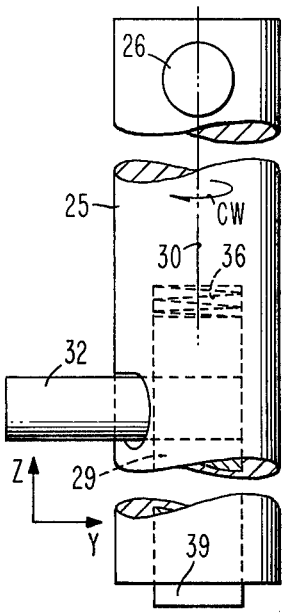
Figure 2C:
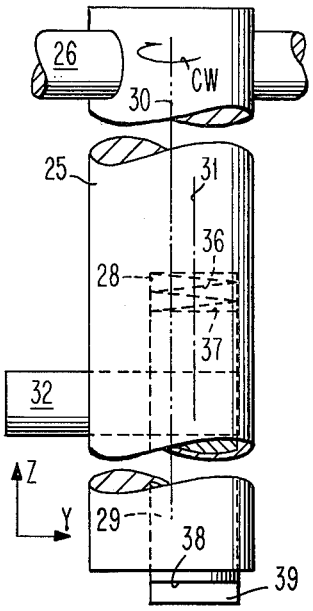

In the preferred embodiment, the cam means includes an elongated cylindrical shaft 25 having a transverse handle 26 at its upper end 27, cf. FIGS. 1 and 2*a*. Concentrically disposed within an offset cylindrical bore 28, FIG. 2*a*, that is provided in shaft 25 for this purpose, is cylindrical cam portion member 29. Stated another way, the center axes 30 and 31 of shaft 25 and member 29, respectively, are offset and parallel with respect to each other, cf. FIGS. 2a, 3a. Radially affixed to member 29 is a detent cylindrical pin 32. For example, pin 32 is threadably engageable with a hole 29A provided in member 29, cf. FIG. 9. The detent pin 32 passes through a circumferential groove 33 which has a predetermined arcuate length and which in the preferred embodiment is 135°, i.e. three quarter radians. The ends of groove 33 extend downwardly to form two circular detent pockets 34, 35 for pin 32, cf. FIG. 2a. A compression spring 36, FIG. 2a, provided in the bore 28 is abutted against the upper face 37 of member 29 causing pin 32 to be biased against the bottom edge of the groove 33. Thus, a predetermined relative rotational motion in the XY plane between the member 29 and shaft 25 is provided, as well as a predetermined amount of relative linear motion in a direction parallel to their respective parallel axes 30, 31.

Figure 3A:
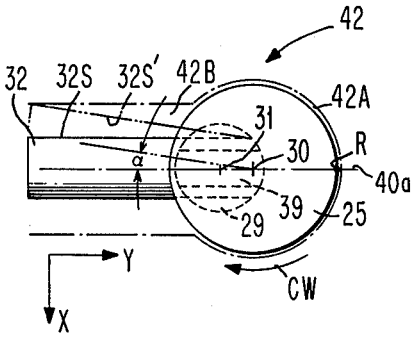
Figure 3B:
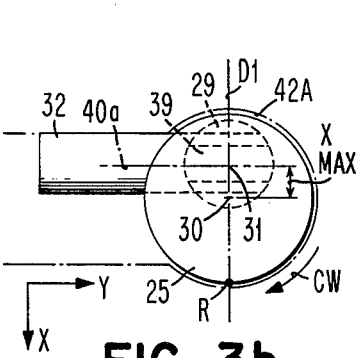
Figure 4A:
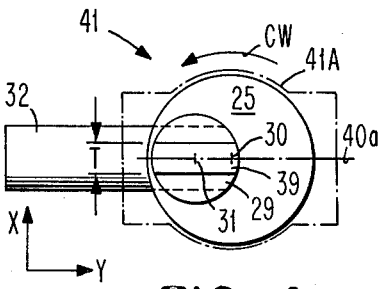
Figure 4B:
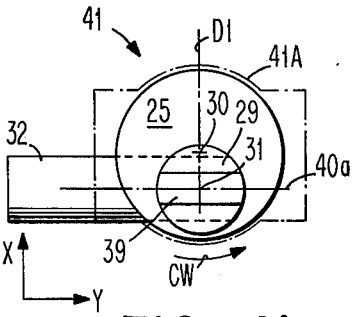
Figure 4C:
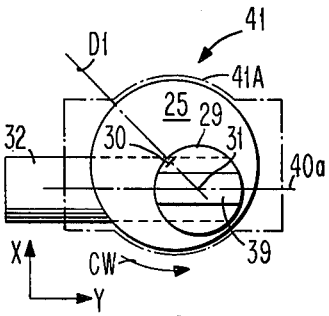

Symmetrically centered on the lower face 38 of the member 29 is an elongated substantially rectangular prism-shaped portion or tip 39 of thickness T, FIG. 4a. Tip 39 is adapted to be slidably mountable in a transverse elongated slot or groove 40 of member 20 having an elongated axis 40a parallel to the Y axis. The shaft 25 is mounted in a circular bearing comprising two respective centrally aligned circular portions 41A, 42A of holes 41 and 42 of member 4 and an anti-tilt block 43, respectively, cf. FIGS. 1, 3a, 4a. Block 43 is mounted to member 10 by screws 44 or alternatively may be integrally formed therein.

The cam means provides relative movement between the assemblies 1 and 15 exclusively in the X direction and prevents or mitigates relative movement in the Y directions. For this purpose, one or more pairs of guide pin and a mating elongated groove is provided. One such pair is shown in FIG. 1 as the cylindrical pin 45 dependent from member 4 and the elongated slot groove 46 of member 20 with which pin 45 co-acts. The elongated axis 46a of groove 46 is parallel to the X axis. Pin 45 is slidable mounted in groove 46 but the dimensions of its transverse shorter axis, which is parallel to the Y axis, and the diameter of pin 45 are such that movements of the pin 45 and, hence, assembly 1 in the Y direction are prevented. Anti-tilt block 43 prevents or mitigates tilting or skewing of the shaft 25 from its parallel relationship with the Z axis and thereby maintains the planar members, such as members 3, 4, 5, 7, 17, 20, in a substantially parallel relationship with the X-Y plane.

Figure 5A:
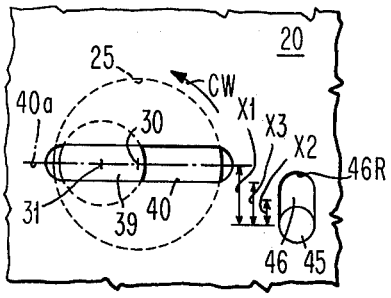

It should be understood that in the drawing, the Figures thereof designated with letter suffixes *a, b* and *c* illustrate the relative positions of the elements shown therein with respect to first, second and third angular positions, respectively, of shaft 25 about the axis 30 of rotation of the cam means and which positions in the preferred embodiment are the 0°, 90° and 135° positions, respectively, of the shaft 25. For sake of explanation, it will be assumed that shaft 25 has a reference diameter axis D1, which in FIGS. 3a, 4a, 5a, is in parallel alignment with the elongated axis groove 40a.

In operation, the respective elements of assembly 1 are pre-assembled. Likewise, the respective elements of assembly 15 are pre-assembled. Assemblies 1 and 15 are then juxtaposed to one another with the pins 2 facing the upper surface 20A. With the aid of pre-registration means 45, 46, the pins 2 of assembly 1 are inserted in a direction parallel to the Z axis into the openings 21 of assembly 15 in a no force insertion manner, as is apparent to those skilled in the art. The pins 45 are inserted in their respective grooves 46 so that they are in substantial abutment with the remote end 46R of their particular groove 46. As a result, each pin 2 is symmetrically positioned in the offset pocket 21A of the particular opening 21. Moreover, the center axis 2a of pin 2 is in substantial alignment with the center line 21c of the opening 21 and which line 21c is parallel to the X axis. The two contact surfaces 19, 18 of the element 16 are symmetrically positioned in the larger pocket 21B of opening 21 and in parallel relationship with the X axis as a result of the pre-assembly of assembly 15, cf. FIGS. 6 and 7a. In addition, pin 45 of assembly 1 is engaged in the remote end 46R of groove 46, cf. FIG. 5a.

Next, with the detent pin 32 seated in detent pocket 34 of groove 33, hereinafter sometimes referred to as the 0° pocket, shaft 25 is inserted with its tip 39 first into the circular part 42A of key-shaped hole 42 of block 43 which has been pre-assembled to the assembly 1. The tip 39, after passing through the aligned hole 41 of member 4, engages the groove 40 of member 20 of the lower assembly 15, the groove 40 being aligned with the tip 39 only if the elements 2, 16 are in the unmated position, cf. FIG. 7a, and the detent pin 32 is the 0° pocket 34, as explained hereinafter in greater detail. It should be noted that when detent pin 32 is in the 0° pocket 34, it is also radially aligned with the shaft 25, the detent pin 32 being radially mounted to member 29, as previously mentioned, cf. FIGS. 2a and 3a. Preferably, the handle 26 is radially oriented on shaft 25 in parallel with the detent pin 32 when the latter is in pocket 34, cf. FIG. 6. As such, with the handle 26 in this orientation, the handle 26 is in parallel alignment with the sides of member 10 that are parallel to the Y axis when the shaft 25 is inserted in the holes 41, 42 and the detent pin 32 is in pocket 34. This thus provides a visual indication to the operator that the detent pin 32 is in pocket 34.

Assuming that the detent pin 32 is in pocket 34 and the shaft 25 is inserted in holes 41, 42 and the tip 39 is engaged in groove 40, the elements 2 and 16 are now ready to be mated. For this purpose, the shaft 25 is rotated concentrically in the circular bearing 41, 42, which acts as the axis of rotation of the cam means. As viewed from the top, to effect the mating the direction of rotation is in the clockwise direction CW.

More specifically, when shaft 25 is rotated in the clockwise direction CW from its initial 0° position, it rotates about its center axis 30 as it turns in the concentric circular portion 42A of keyhole-shaped opening 42 and lower circular portion 41A of opening 40, cf. FIGS. 3a, 4a. In FIGS. 3a – 3c, 4a – 4c, respective holes 42 and 41 are shown in outline form and the handle 26 is omitted for sake of clarity. As a result, detent pin 32 pivots about center axis 30 of shaft 25 as it is carried thereby with tip 39 remaining in radial alignment with shaft 25. This occurs until side 32s of pin 32 contacts the linear side portion 42B of the keyhole 42, as is shown by its outline form 32S' in FIGS. 3a. When this occurs, shaft 25 will have rotated through an initial angle $\alpha$, illustrated greatly exaggerated in FIG. 3a for sake of clarity, about its center axis 30. The parameters of the detent pin 32, members 25, 29 and holes 41, 42, are judiciously selected so that the angle $\alpha$ is substantially negligible, e.g. 5° or less, compared to the angle of cam motion travel, which in the preferred embodiment is 135°, as aforementioned. It should be understood that as a result the elongated axis of tip 39 in the XY plane is slightly skewed a corresponding angle $\alpha$ with the center axis 40*a* of groove 40 of member 20. However, because the angle $\alpha$ is negligible, tip 39 is still freely slidable in the groove 40 along axis 40*a* when the shaft 25 is subsequently rotated in the CW direction after being rotated the initial angle $\alpha$. Consequently, for sake of clarity, the center elongated axis of tip 39 and the center axis of detent pin 32 are shown in FIGS. 3*a* - 3*c*, 4*a* - 4*c* and/or 5*a* - 5*c* as being substantially in parallel alignment along the Y axis and, hence, with the axis 40*a*.

Thus, during rotation of shaft 25 through the initial angle $\alpha$, there is no relative movement between assemblies 1 and 15. Moreover, there is no relative movement between shaft 25 and member 29, and only a slight but negligible angular movement between the member 29, and, hence, the shaft 25, with respect to groove 40. Thus, for purposes of explanation, the center 30 of shaft 25 can be considered aligned with the axis 40*a* of groove 40, shown superimposed therewith in FIG. 3*a*.

Once, side 32S of pin 32 contacts side 42B, detent pin 32 is prevented by side 42B from remaining in radial alignment with shaft 25 as the latter continues to rotate clockwise. Furthermore, as the shaft 25 continues to rotate clockwise about axis 30, the resultant follower action causes detent pin 32 to lift out of pocket 34 as the lower side of the groove 33 on shaft 25 slides thereby. Tip 39 is of sufficient height to insure that the tip 39 remains in the groove 40 of member 20 when this occurs.

There is thus now provided relative rotational movement between shaft 25 and member 29 which allows the shaft 25 to rotate freely in the CW direction about center axis 30 in the concentric bearing, i.e. circular portions 41A, 42A. The member 29 and, hence, detent pin 32 are now carried by shaft 25 with the parallel center axes of pin 32 and tip 39 in substantial parallel alignment with the Y axis. Groove 40 allows tip 39 to move freely in the Y direction and thus tip 39 does not provide any lateral force, i.e. force in the Y direction, in the groove 40. Consequently, there is no relative movement between assemblies 1 and 15 in the Y direction.

On the other hand, groove 40 which is part of member 20 is connected to the stationary assembly 15. Consequently, when shaft 25 continues to rotate substantially concentrically in its circular bearing 41, 42, the elongated sides of groove 40 prevent the tip 39 from being displaced in the X direction. As a result, as shaft 25 rotates, it provides a reaction force in the X direction which is transmitted through its bearing, i.e. circular portions 41A, 42A of holes 41, 42, to the member 10 and consequently to assembly 1 of which member 10 is a part. This in turn causes assembly 1 to move in the X direction relative to the stationary assembly 15. It should be understood that for sake of clarity, hole 42 is illustrated greatly exaggerated in FIGS. 3*a* - 3*c*.

When the shaft 25 has rotated in a clockwise direction to the 90° position shown in FIGS. 2*b*, 3*b*, 4*b*, 5*b*, the tip 39 has been displaced in the Y direction along groove 40. At the same time reference point R, which coincides with the intersection of the shaft's circumference and reference diameter D1, has been positioned from a zero displacement in the X direction with respect to the axis 40*a* shown in FIG. 3*a* to its maximum displacement shown in FIG. 3*b*. The maximum displacement corresponds to the distances Xmax between centers 30 and 31. As a result, assembly 1 is displaced in the X direction with respect to assembly 15 by a corresponding amount Xmax.

Figure 3C:
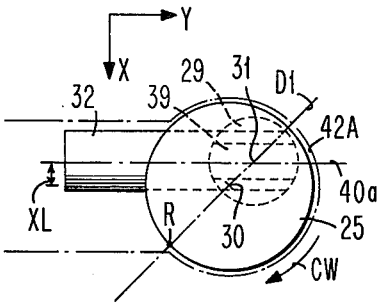

Further rotation in the clockwise direction from the 90° position causes the reference point R to be displaced with respect to the groove axis 40*a* in the reverse X direction while tip 39 continues to be displaced freely in the Y direction along groove 40. Thus, when the shaft 25 reaches its 135° position as shown in FIG. 3*c*, the reference point R is displaced by an amount XL<Xmas from the center axis 40*a* of groove 40. At this point, detent pin 32 is at the end of groove 33 and has dropped into the detent pocket 35 thereof. This reversal in displacement from the forward X direction causes the assembly 1 to also be displaced in the reverse X direction with respect to the stationary assembly 15. Further rotation in the clockwise direction is now prevented and the shaft 25 and tip 39 are withdrawn and removed from the openings 40 - 42.

Referring to FIGS. 6 and 7*a* - 7*d*, there are diagrammatically shown displacements along the X direction of the assembly 1 via pin 2 with respect to the stationary assembly 15 via member 20 resulting from the clockwise rotation of shaft 25 beginning with FIG. 7*a*, which corresponds to the 0° shaft position, and next with FIG. 7*d*, which corresponds to some intermediate shaft position between the 0° and 90° positions, and thereafter in sequence with FIGS. 7*b* and 7*c* which corresponds to the 90° and 135° shaft positions, respectively. Displacement of assembly 1 in the X direction causes the pins 2 carried in assembly 1 to be also displaced in the X direction. As a result, each pin 2, as it moves in the X direction, contacts the inwardly inclined faces of the contact surfaces of element 16 located in the recess 21 of the member 20 which is part of the stationary assembly 15. The moving pin 2 exerts a force against the inclined faces which pushes the element 16 in the X direction causing it to resiliently bend in that direction. In response to the force exerted by moving pin 2, the element 16 continues to bend until the remote edges 18E, 19E of the surfaces 18, 19 are placed in contact with the back wall 21D of recess 21 thus preventing further movement of the element 16 in the X direction. As a result, the moving pin 2 forces the surfaces 18 and 19 apart from each other parallel to the Y axis so as to accept the pin 2 between their parallel parts or faces, as shown in FIG. 7*d*. The resiliency of the bifurcated arms of the element 16, however, urges the surfaces 18, 19 to be in good wiping contact with the pin 2. As the assembly 1 and, hence, pin 2 continues to be displaced in the X direction, the pin 2 slides across the parallel faces of the contact surfaces 18 and 19. Consequently, when the shaft 25 has been rotated to its 90° position, the left ends 18E, 19E as viewed facing FIG. 7*b*, of contacts 18, 19 and pin 2 will be in aligned tangency with the flat back wall 21D of recess 21 which thus acts as a reference point of alignment for the system 2, 18, 19. For sake of clarity, for the 90° position of shaft 25 the mating pin is shown in FIG. 6 in the outline form identified with the reference character 2' therein and the common center portion of the bifurcated spacing element 16 is indicated by its phantom outlined center axis 16'.

To better understand the present invention, it should be understood that in the aforedescribed prior art device with comparable elements 2, 16 and 21, the cam mechanism described therein causes a similar deflection, i.e. bend, in the aforementioned bifurcated member thereof. This deflection creates undue and undesirable stresses in the insulator base member. Moreover, for comparable size elements 2, 16, 21, the prior art cam mechanism maintains the bifurcated member in the bent position and is not able to relieve the resultant undesirable stresses on the base member. The base member which is made of plastic, is thus susceptible to deformation and/or damage, destruction or failure by the prior art device due to the compression forces, which are caused by the deflected bifurcated member, being exerted against it. Moreover, as aforementioned in the prior art device, intentional or further rotation of the prior art shaft in the same rotational direction would only tend to further deflect the bifurcated member in the same linear direction thereby creating even greater stresses in the base member.

Now in accordance with the principle of the cam mechanism of the present invention, the shaft 25 is rotated in the same direction, i.e. clockwise, from its 90° position but displaces the assembly 1 and, hence, pin 2 in the opposite, i.e. reverse, X direction. This causes the pin 2 to move in the reverse X direction, there being sufficient friction between the parallel parts of the contact surfaces 18, 19 and pin 2 so that the pin 2 carries the element 16 back towards its normal, i.e. perpendicular, non-deflected position. Thus, when the shaft 25 reaches its 135° position, the pin 2 is between the parallel faces of the contact surfaces 18, 19, and the pin 2 and edges 18E, 19E and tangential to a plane E, which is parallel to wall 21D, cf. FIG. 7*c*. For sake of clarity, when element 16 is in its normal undeflected position, the mating pin 2 is in the position shown by the phantom outline 2″ in FIG. 6. Thus, the mated member 16 is removed from contact with the member 20 and the undesirable stresses are relieved and in a self-relieving manner by the cam means of the present invention.

Thus, with the shaft 25 in the 135° position, the simultaneous mating of the pins 2 with their respective elements 16 has been effected and the shaft 25 may be removed. Thereafter, as aforementioned, the assemblies 1 and 2 may be more readily affixed to each other on a more premanent but demountable basis by any appropriate means such as the aforementioned bolts, not shown, which co-act with holes 11A, 23. In the event it is desired to unmate pins 2 and elements 16, these last-mentioned bolts must be removed.

To unmate the pins 2 and elements 16, the shaft 25 with detent pin 32 in pocket 35 is reinserted in holes 41, 42 so that tip 39 is in engagement with groove 40 and the shaft 25 is rotated in the opposite, i.e. counterclockwise direction, causing a reverse sequence of operations.

Figure 5B:
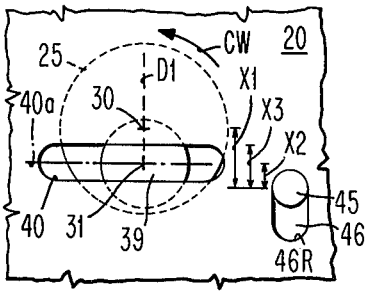
Figure 5C:
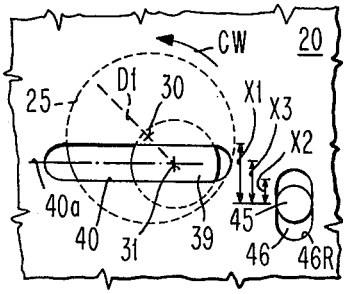

As aforementioned, the tip 39 engages groove 40 only if the detent pin 32 is in the 0° position and the electrical pins 2 and their associated mates 16 are not mated. Similarly, tip 39 engages groove 40 only if the detent pin 32 is in the 135° pocket and the electrical pins 2 and elements 16 are mated. Referring to FIG. 5*a*, the distance X1 represents the X distance between the center axis 40*a* groove 40 which is associated with assembly 15 and the center of guide pin 45 which is associated with assembly 1 when the shaft is in the 0° position. In FIG. 5*b*, the distance X2 represents the distance between center axis 40*a* and the center of pin 45 when shaft 25 is in the 90° position. In FIG. 5*c*, the distance X3 represents the distance between center axis 40*a* and the center of pin 45 for the 135° position of shaft 25. In those positions, the center line of the tip 39 is co-aligned with the center axis 40*a*. Thus, for the relationship $X1>X3>X2$ and as shown in FIG. 5*a* by the dimensions X2, X3 taken from the center of pin 45 as a reference, the corresponding center lines of tip 39 are at or below the lower edge or groove 40 and, hence, tip 39 cannot enter and/or be engaged by groove 40 when the pin 32 is not in the detent pocket 34. In a similar manner, as shown by dimensions X1, X2 in FIG. 5*c*, the tip 39 is not engageable with the groove 40 when the pin 32 is not in the detent pocket 35.

In the embodiment of FIGS. 1 - 9, the member 29 is an elongated cylindrical piece of length L which has the tip in its lower face 38. Threaded hole 29A engages the threaded detent pin 32, not shown in FIG. 9 for sake of simplicity. It is desired to provide some degree of flexure bidirectionally along the X axis in lieu of the elongated cylindrical shape of member 29, the lower cylindrical part of the member 29 may be replaced by an elongated shank which is integrally connected to the tip 39 with a corresponding shape as shown in phantom outline 39′ in FIG. 9. Another alternative would be to provide flexure in only one direction along the X axis by providing a semicylindrical portion 29′ to the elongated shank 39′ near the tip 39 as shown in FIG. 10. Portion 29′ is of comparable diameter as the upper cylindrical part of member 29 and fits into the bore 28 of shaft 25.

Preferably, the cam means of the present invention displaces a movable assembly 1 with respect to a stationary assembly 15, and particularly where the assembly includes a plural array of integral sections of frame 22 and a common mother printed circuit board 17, as shown in FIG. 1. However, as is obvious to those skilled in the art, the cam means of the present invention can provide other relative motions between two assemblies. For example, assembly 1 can be maintained stationary and assembly 15 displaced with respect to it by the cam means. In such a case, the assembly 15 would include independent, i.e. non-integral, sections of frame 22 to each of which is attached an independent printed circuit board having an array 16A of elements 16. Moreover, the cam means of the present invention while preferably being utilized for mating electrical connectors can be used to mate other types of matable elements such as those used, for example, for making purely mechanical connections.

While the invention has been particularly shown and described with reference to preferred embodiments thereof, it will be understood by those skilled in the art that the foregoing and other changes in form and details may be made therein without departing from the spirit and scope of the invention.

We claim:

1. Apparatus for simultaneously interconnecting plural first mating member means with plural second mating member means in mutually exclusive pairs, said apparatus comprising:

first assembly means for supporting said plural first member means in a predetermined array, second assembly means for supporting said second member means in a corresponding array, said first and second assembly means being juxtaposed with respect to each other to provide relative linear motion therebetween, and cam means for effecting said linear motion in a bidirectional manner in response to a rotational force applied thereto about a predetermined axis of rotation, said rotational force being applied in a given direction about said axis between first and second predetermined angular positions to provide said linear motion in a first linear direction to effect said interconnecting of said plural first and second mating member means, said rotational force being further applied in said given direction about said axis between said second angular position and a third predetermined angular position to provide said relative linear motion in an opposite second linear direction to relieve undesirable stresses when present in at least one of said first and second assembly means of said apparatus caused by the interconnection of said first and second plural member means.

2. Apparatus according to claim 1 wherein said rotational force is applied in the opposite direction about said axis to disconnect said first and second plural member means.

3. Apparatus according to claim 1 wherein each of said first member means is an electrical connector of the pin type and each of said second member means is an electrical connector of the bifurcated spring type.

4. Apparatus according to claim 1 wherein said cam means further comrises:

an elongated shaft having an offset internal cylindrical cam portion therein and an engagement component outwardly dependent from said cam portion and protruding from a predetermined end of said shaft, said cam portion being mounted in said shaft to provide relative movement therebetween, circular hole means disposed on said first assembly means for receiving said shaft, and elongated slot means disposed on said second assembly means for receiving said engagement component, said rotational force being applied to said shaft, and said component in response to said rotational movement providing said linear motion between said first and second assembly means.

5. Apparatus according to claim 4 wherein said cam means further comprises:

detent means for detenting said shaft at said first and third angular positions.

6. Apparatus according to claim 4 wherein said elongated slot means receives said engagement component either when said shaft is in said first angular position and said first and second mating means are unmated or when said shaft is in said third angular position and said first and second mating means are mated.

7. Apparatus according to claim 4 wherein said engagement component has a point of flexure in said first direction of said linear motion.

8. Apparatus according to claim 7 wherein said engagement component further has another point of flexure in said second direction of said linear motion.

9. Apparatus according to claim 4 wherein said first assembly means comprises a circuit module having plural electrical pin connectors, each of said plural first member means comprising a mutually exclusive one of said pin connectors, and said second assembly means further comprising an interconnector board having plural bifurcated spring type electrical connectors, each of said second plural second member means comprising a mutually exclusive one of said bifurcated connectors.

10. Apparatus according to claim 9 wherein said second assembly means further comprises a stressable member having a plurality of recesses and further having said slot means, each of said recesses having one of said pin connectors and one of said bifurcated connectors disposed therein, said undesirable stresses when present being effected in said stressable member.

* * * * *